US007013590B1

(12) United States Patent
Bell et al.

(10) Patent No.: US 7,013,590 B1
(45) Date of Patent: Mar. 21, 2006

(54) FLOOR SIGN

(75) Inventors: William E. Bell, Lawrenceville, GA (US); Donald M. Kizer, Smyrna, GA (US)

(73) Assignee: Carlisle FoodService Products, Incorporated, Oklahoma City, OK (US)

( * ) Notice: Subject to any disclaimer, the term of this patent is extended or adjusted under 35 U.S.C. 154(b) by 0 days.

(21) Appl. No.: 10/375,236

(22) Filed: Feb. 27, 2003

(51) Int. Cl.
*G09F 15/00* (2006.01)

(52) U.S. Cl. ..... 40/610; 40/606

(58) Field of Classification Search ..... 40/610, 40/612; 116/63 P
See application file for complete search history.

(56) References Cited

U.S. PATENT DOCUMENTS

| | | | | |
|---|---|---|---|---|
| 4,253,260 | A | 3/1981 | Maza et al. | |
| 4,298,186 | A | 11/1981 | Glass | |
| 4,796,369 | A * | 1/1989 | Hamann | 40/606.15 |
| 4,974,815 | A | 12/1990 | Glass | |
| 4,999,937 | A | 3/1991 | Bechtold | |
| 5,003,912 | A | 4/1991 | Thurston | |
| 5,009,541 | A * | 4/1991 | Thurston | 404/6 |
| 5,046,885 | A | 9/1991 | Thurston | |
| 5,458,434 | A | 10/1995 | Bent et al. | |
| 5,621,992 | A | 4/1997 | Mandell et al. | |
| 5,964,053 | A | 10/1999 | Liu | |
| 6,003,257 | A | 12/1999 | Stokes | |
| 6,131,320 | A * | 10/2000 | Eberle et al. | 40/610 |
| 6,338,213 | B1 | 1/2002 | Young et al. | |

* cited by examiner

*Primary Examiner*—Cassandra Davis
(74) *Attorney, Agent, or Firm*—McAfee & Taft

(57) ABSTRACT

A floor sign comprising two substantially similar panels and an engaged slidable locking bar. Each panel has a pair of closely spaced apart tabs with an aperture through each and a tab having a boss on both sides. The two panels engage each other at their upper end by interlocking the pair of tabs with the tab bosses. The upper portions of the panels are pivotably coupled. The locking bar has an upper horizontal section and a vertically depending section and is inserted between the two panels for maintaining the panels in a spaced apart deployed position or in a collapsed position. The floor sign is deployed by pressing downward on the locking bar to insert the bar between the panels, forcing them apart at a ridge on the inner face of each panel. The bar locks to maintain the lower ends of the panels in a spaced apart configuration. To collapse the sign a user lifts upward on the locking bar via a notch in the panels to release the locking bar and permit the panels to collapse toward each other.

32 Claims, 6 Drawing Sheets

FLOOR SIGN

FIELD OF THE INVENTION

The present invention relates to floor signs. More particularly, the present invention relates to free-standing floor signs for displaying caution messages and which can also function as an easily deployed temporary barrier to passers by.

BACKGROUND OF THE INVENTION

Conventional free-standing floor signs have been developed with the idea of providing an easily deployed mechanism for alerting passersby of a condition, such as a wet floor, construction overhead, a hole or other condition which might pose a danger or concern for someone in the vicinity. Most frequently, a store or office will place a wet floor sign in the area where a recent spill has occurred to reduce the likelihood that someone will slip on the wet floor. Conventional signs are generally a pair of opposing panels with each panel containing a message printed thereon. The panels are typically coupled at the top by a hinge mechanism. Several signs lock in place by various mechanisms, such as a locking arm that couples the lower portions of the panels together in a removably fixed relationship.

Many of the floor signs developed leave substantial room for improvement in design and functionality. Several of the signs have metal pieces which raises the cost of manufacturing and assembly and the corrosion or metal over time can cause structural failure or aesthetically unappealing signage. The complexity of the design of other signs increases the number of parts needed for assembly, thereby raising costs of manufacturing. Many of these signs require deployment or collapsing using two hands and/or several cumbersome and time consuming steps to achieve the resulting configuration.

It would be desirable to have an easy to use free-standing floor sign which would be expandable from a collapsed position using only one hand and which could be collapsed for transportation or storage using only one hand. Further, it would be desirable to have a floor sign which could be set up or collapsed in a single step operation. Additionally, it would be desirable to have a floor sign that could expand to a predefined width between the panels for optimal stability. Moreover, it would be desirable to have a floor sign which would be stable without requiring panel cross braces for structural stability. It would still further be desirable to have a floor sign which would minimize the number of parts required for assembly and operation, such as by eliminating a separate hinge pin or cross brace, which otherwise increase manufacturing and assembly costs and time. It would likewise be desirable to have a floor sign which requires only one panel design to minimize mold costs.

SUMMARY OF THE INVENTION

Generally described, the present invention provides in one exemplary embodiment a free-standing floor sign having a front panel and a rear panel pivotably coupled together at an upper end and a locking bar located at the coupling. The locking bar interacts with the panels to provide a stable structure that is locked in the expanded position until a user raises the bar to unlock the panels and permit collapsing of the panels toward each other for transportation and storage. The panels may be essentially identical and, where the material is a moldable plastic, a single mold cavity can be used to produce both panels. The panels have a pair of ears each with an aperture therein on one side of the upper end and a tab with a boss extending therefrom on the other side of the upper end, both on the inner face of the panel. When the inner faces of both panels are pressed together, the tab boss fits between the two tabs with apertures and the boss snap fits within the apertures to form a hinge coupling. The panel has a ridge on the inner face which interacts with the locking bar. The panel also has a handle section for permitting a user to carry the sign and to release the locking bar.

The locking bar has a flat horizontal section and a downwardly depending vertical section with generally parallel sides which terminates in tapered tip. The vertical section has a pair of shoulders, each shoulder having a pair of stops to prevent removal of the locking bar when in position. The locking bar fits between the two panels upper ends and between the pair of tabs with apertures and the tab with the boss. When pressed into the lower position the tapered tip contacts the ridges on the inner face and force the panels apart, causing the panels upper ends to pivot and the lower ends to separate. The floor sign is maintained locked in the expanded position by the presence of the locking bar vertical section side walls being between the ridge or ridges on each of the panels.

To assemble the unit the locking bar is placed between two panels and the panels snap fit together at the tabs with the tab boss snap fitting between the pair of tabs with apertures. When in the collapsed position the locking bar is raised and when in the deployed position the locking bar is pressed downward. When the deployed floor sign is to be picked up and collapsed the user grasps the handle and lifts up on the locking bar, causing it to be displaced from between the ridges and the panels pivot into the collapsed position.

The present invention can be adapted for use as a sawhorse, police barricade, or other free standing structure. The present invention can also be modified to be used in a folding table or chair or other structure which, when deployed, needs to be maintained in a fixed position.

In one particular exemplary embodiment, the present invention provides a floor sign, comprising: a generally flat front panel comprising an inner face having a left side and a right side, an outer face, an upper end, a lower end for resting on the ground or floor, a notch formed therein, at least one first tab having an aperture formed therein extending from the upper end of the inner face, a second tab having a boss extending from both faces thereof and extending from the upper end of the inner face, the boss being generally coaxial with the at least one first tab aperture, a ridge extending from the left side of the inner face, and a ridge extending from the right side of the inner face; a generally flat rear panel comprising an inner face having a left side and a right side, an outer face, an upper end, a lower end for resting on the ground or floor, a notch formed therein, at least one first tab having an aperture formed therein extending from the upper end of the inner face, a second tab having a boss extending from both faces thereof and extending from the upper end of the inner face, the boss being generally coaxial with the at least one first tab aperture, a ridge extending from the left side of the inner face, and, a ridge extending from the right side of the inner face; and, a locking bar pivotably coupling the front panel and the rear panel together for opening and closing movement relative to one another, the locking bar comprising, a generally flat horizontal top first section, and a downwardly extending vertical second section having a proximal end associated with the first section and a distal end, the distal end being tapered, the locking bar being movable from an upper position to a lower position when coupling the front panel and the rear panel such that when the locking bar is in the upper position the front panel and the rear panel lower ends are in close proximity so as to be in a closed position and when the locking bar is in the lower position the locking bar tapered distal end engages the ridges and urges apart the lower ends of the front panel and the rear panel so as to be in an open position. The floor sign further has the locking bar urged into the lower position by pushing the top first section downward toward the lower end and the locking bar is urged into the upper position by urging the distal end upward.

Other features and advantages of the present invention will become apparent upon reading the following detailed description of embodiments of the invention, when taken in conjunction with the appended claims.

BRIEF DESCRIPTION OF THE DRAWINGS

The invention is illustrated in the drawings in which like reference characters designate the same or similar parts throughout the figures of which.

DETAILED DESCRIPTION OF THE EMBODIMENTS

Figure 1:
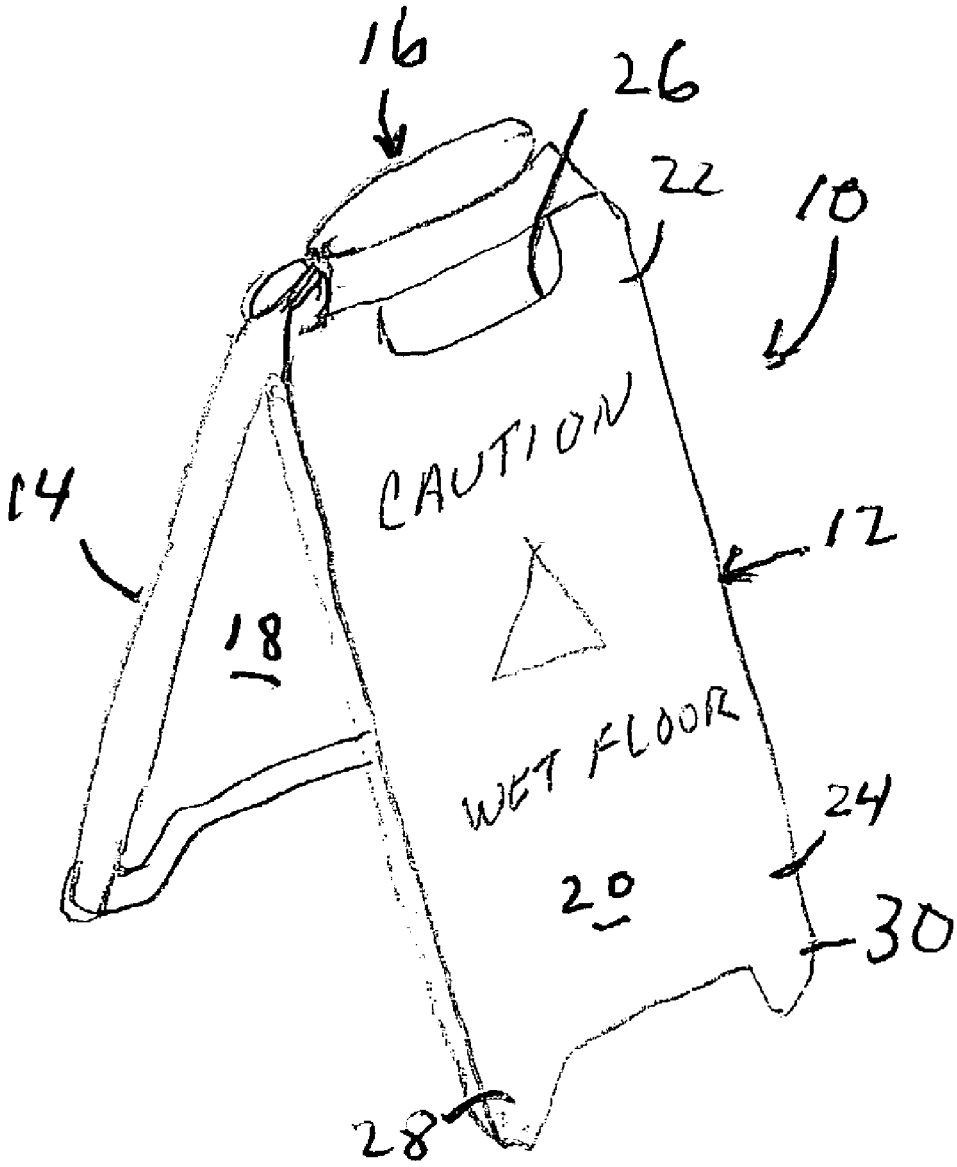
FIG. 1 is a perspective schematic view of one exemplary embodiment of the floor sign of the present invention.

FIGS. 1–13 show a first exemplary embodiment of a floor sign 10 of the present invention, which generally comprises a front panel 12, a rear panel 14 and a locking bar 16.

The front panel 12, rear panel 14 and locking bar 16 can be made of any generally rigid material, such as, but not limited to, plastic, wood, metal, ceramic, polymer, combinations thereof and the like. A preferred material is polypropylene. the material can be tinted, such as with a high visibility bright yellow color. The front and rear panels 12, and 14 can have text or indicia printed thereon, such as a warning message alerting passers by of a wet floor in the vicinity.

Figures 2, 3, 4:
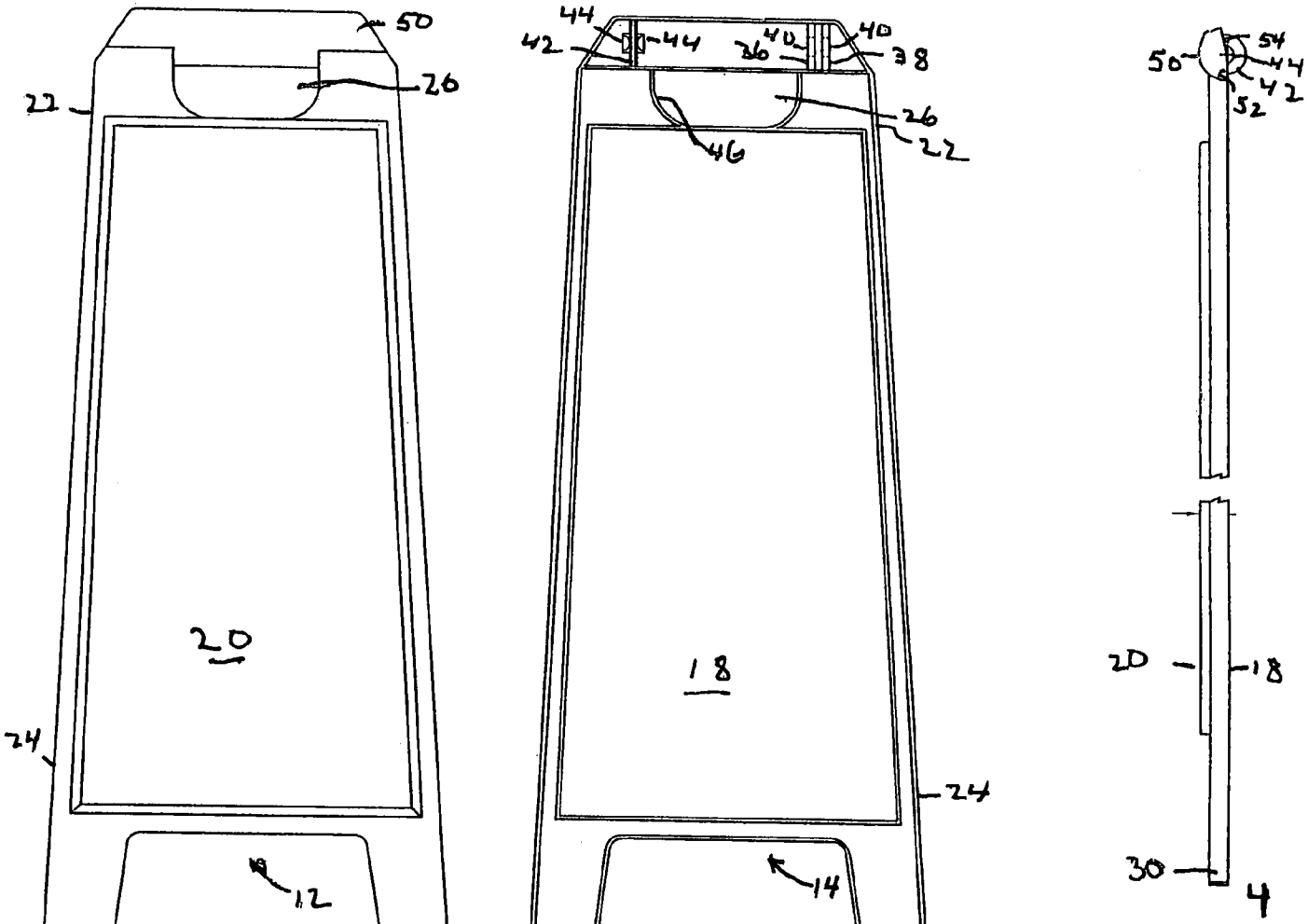
FIG. 2 is a front elevational schematic view of the front of the panel.
FIG. 3 is a front elevational schematic view of the rear of the panel.
FIG. 4 is a side elevational schematic view of the panel.
Figure 5:
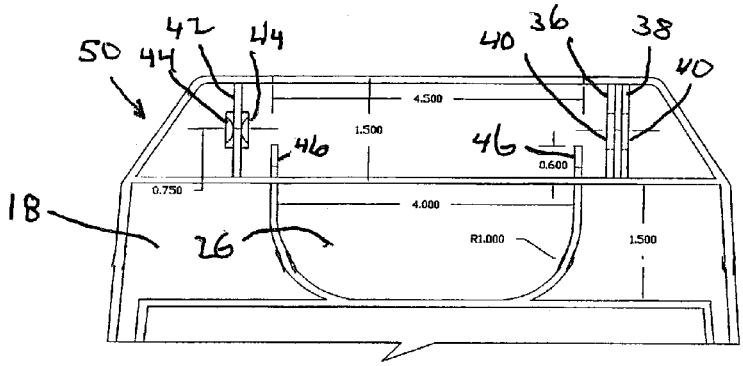
FIG. 5 is a schematic view of a detail of the top portion of the floor sign.
Figure 6:
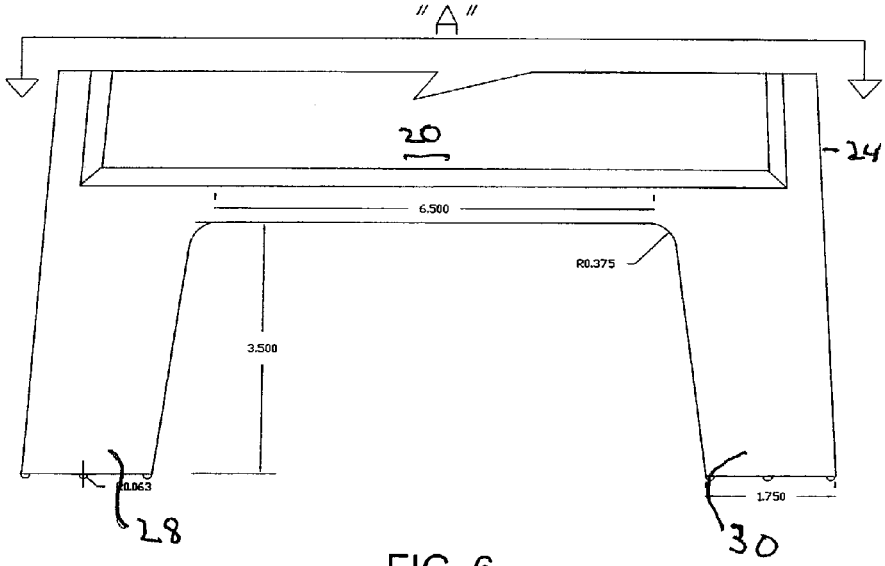
FIG. 6 is a schematic view of a detail of the upper portion of the floor sign.
Figure 8:
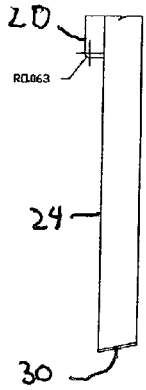
FIG. 8 is a side elevational view of the upper portion of the floor sign of FIG. 6.
Figure 7:
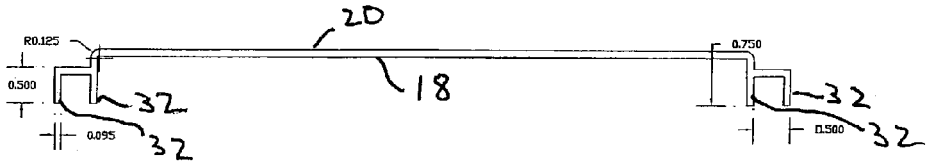
FIG. 7 is a cutaway view taken along line A—A of FIG. 6.
Figure 9:
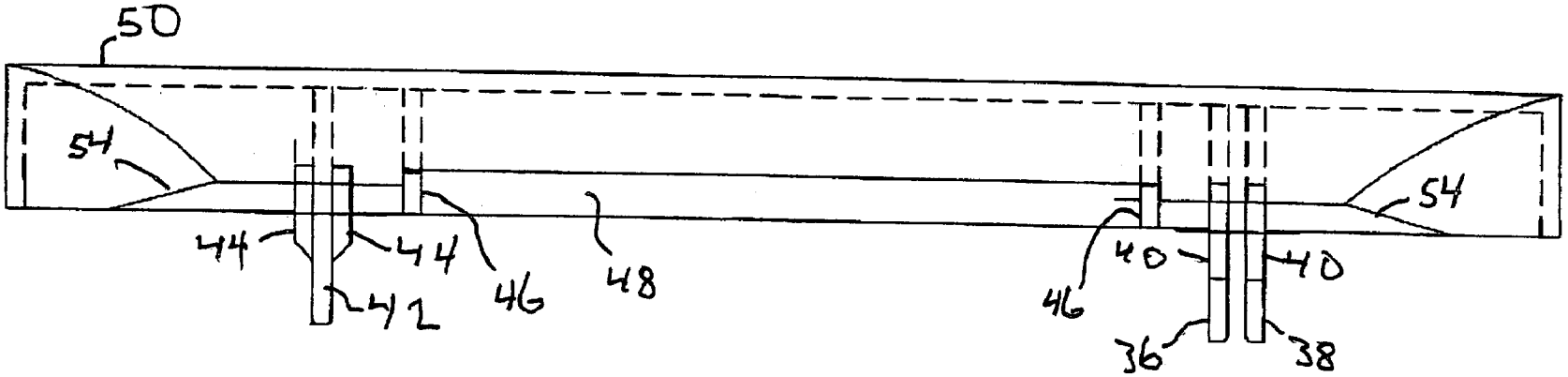
FIG. 9 is a detail view of the top portion of the panel showing the tabs.

As shown in FIGS. 2–4, the front of the panel 12 comprises an inner face 18, an outer face 20, an upper end 22 and a lower end 24. Preferably, a cutout 26 is in the upper end 22 area sized to receive a user's fingers. Alternatively, the cutout 26 can be eliminated. The lower end 24 can have legs 28 and 30 or can be flat. As illustrated in FIG. 7, the front panel 12 can optionally have ribs 32 or ridges or similar structure for increased strength and support. FIGS. 5–7 show detailed views of the upper end 22 of the front panel 12. Viewed from the inner face 18, the upper end 22 has at least one and preferably two tabs 36 and 38 extending perpendicularly outward from the left side of the inner face 18. The tabs 36 and 38 are preferably spaced slightly apart, about the distance roughly equivalent to the width of the tab. Each tab 36, 38 has an aperture 40 defined therein. The upper end also has a tab 42 extending perpendicularly outward from the right side of the inner face 18. The tab 42 has a boss 44 preferably extending from both sides. In an alternative embodiment where only one tab 36 is utilized, the tab 42 can have a boss extending from only one side. The boss 44 is generally co-axial with the apertures 40.

A ridge 46 extends outward from the left side and from the right side of the inner face 18, as shown in FIG. 5. The ridge 46 is preferably angled upward from the upper end 22 toward the lower end 24 and interacts with the locking bar 16, as discussed hereinbelow. The top of the upper end 22 preferably has a notch 48 sized to receive a portion of the locking bar 16. Alternatively, only one central ridge 46 may be used, such as where there is no cutout 26.

The rear panel 14 is constructed in a manner substantially similar to the front panel 12. The indicia may be the same or different. The two panels 12, 14 are coupled together at their upper ends by facing the inner faces together and inserting on each panel the tab 42 between the tabs 36, 38 so that the boss 44 on both sides of the tab 42 snap fits within the aperture 40 of each tab 36, 38. This results in the two panels 12, 14 being pivotably coupled at the upper end 22. It should be noted that the two panels 12, 14 can be constructed using the same mold (where made of moldable material), so that two identical panels can be fitted together to form the floor sign 10. This obviates the need for two different molds. Where the present invention is not molded, the panels 12, 14 are still preferably identical, so that the cost for manufacturing is lowered by having fewer different pieces required to make the floor sign 10. Additionally, the tab construction eliminates the need for a separate pin to form the hinge mechanism.

Figure 10:
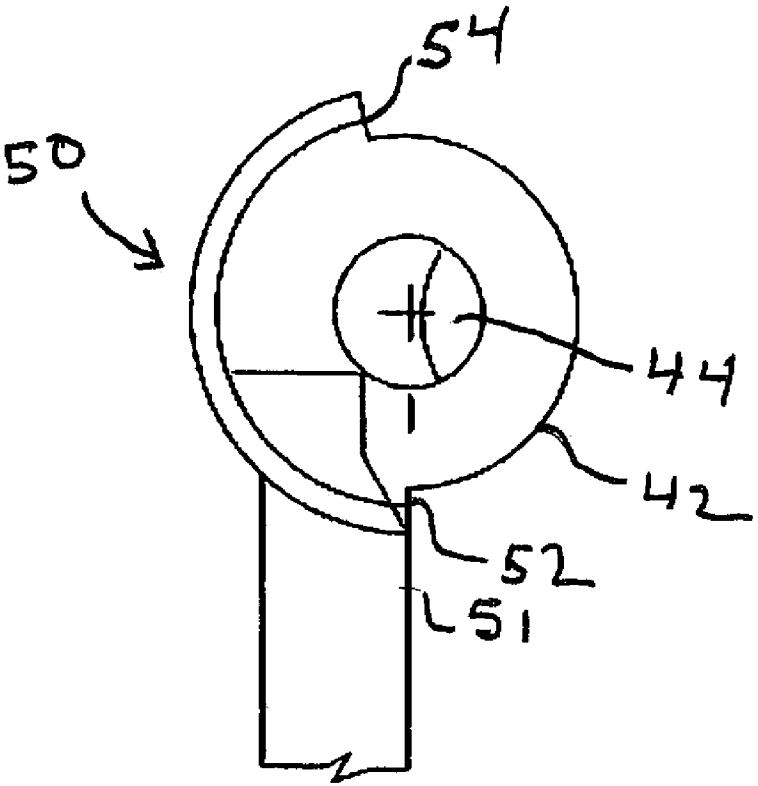
FIG. 10 is a side elevational view of the top of the panel.

The upper end 22 preferably has a half-handle 50 and a side edge 51 having a straight portion 52 and an angled portion 54, as shown in FIG. 10. When the panels 12, 14 are coupled together and in the collapsed position, the straight portion 52 of the front panel side is generally parallel and in proximity to the straight portion 52 of the rear panel side. By collapsed, it is meant that the panels are generally parallel to each other and the lower ends 24 are close together. This position may be the most efficient for transportation and storage. When the floor sign 10 is deployed, as shown in FIG. 1, and the lower ends 24 spread apart, the angled portion 54 of the front panel 12 is pivoted into an abutting or proximate relationship to the angled portion 54 of the rear panel 14, thus providing a stop to maintain the lower ends 24, in a spaced apart relationship, yet preventing overspreading of the lower ends. In one embodiment, the angled portion 54 is angled at about 12 degrees from the vertical, which results in the lower ends 24 being able to spread apart about a foot or so for a conventional floor sign, resulting in a stable base. The angle of the angled portion 54 is not critical, nor is the base spread distance between the lower ends 24 of the panels 12, 14. For different applications, different panel 12, 14 angles may be optimal for different structures or applications, therefore, the angle of the angled portion 54 may change. Also, the panels may optionally be designed to be attackable so that a number of floor signs 10 can be stacked vertically or horizontally in a relatively stable arrangement.

Figure 12:
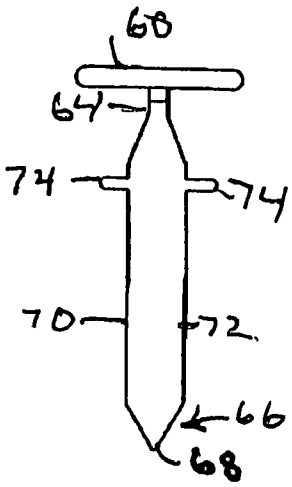
FIG. 12 is a side elevational view of the locking bar.
Figure 11:
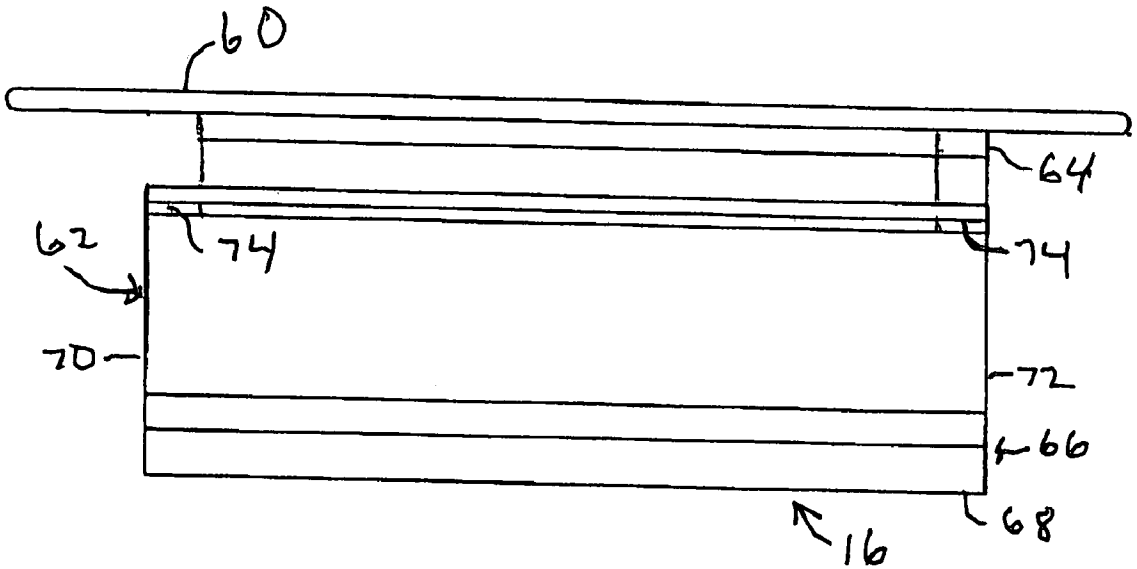
FIG. 11 is a front elevational view of the locking bar.
Figure 13:
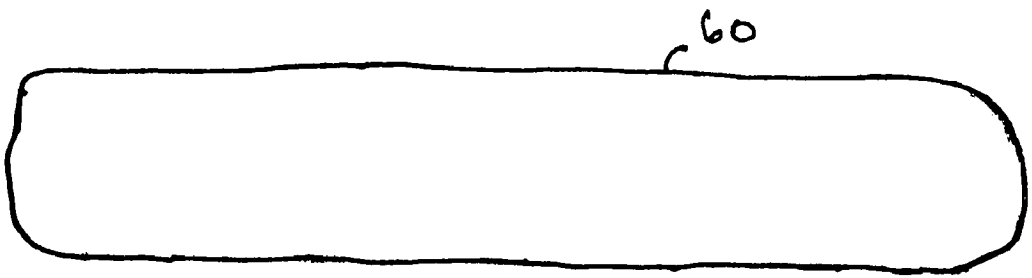
FIG. 13 is a top view of the locking bar.

As shown in FIGS. 11–13, the locking bar 16 has a horizontal top member 60 and a vertically depending elongated member 62 comprising a first section 64 being preferably tapered toward the top member 60 and also comprising a second section 66 having a distal end 68 that is preferably tapered. Alternatively, the distal end 68 can be curved convex or concave, although this may increase the force required to urge the panels apart. The second section 66 also has generally parallel opposing sides 70 and 72. The beveled end 68 engages the ridge 46 when the locking bar 16 is pressed to the lowered position, urging the ridges 46 on each panel 12, 14 apart. Preferably, the first section 64 is narrower in width than the second section 66. The second section 66 has a set of beveled projecting stops 74 which contact the upper end 22 when the locking bar 16 is in the raised position and prevent the locking bar 16 from being removed from the floor sign 10.

ASSEMBLY

As described above, the panels 12 and 14 are positioned opposing each other with the inner face 18 facing toward each other. The locking bar 16 is positioned between the tabs 36, 38 and tab 42 and the two panels are snap fit together so that the tabs 36, 38 engage the tab 42. The locking bar 16 will be in the raised position and the two panels 12, 14 will be in a generally parallel and closed position.

OPERATION

A user grasps the upper end 22 and preferably using his/her palm presses the top section 60 down toward the lower end 24. Preferably, the user curls his/her fingers around the upper end so that there is a gap between the thumb and other fingers through which the distal end 68 can pass. As the locking bar 16 is lowered, the tapered tip of the end 68 engages the ridges 46 on each panel 12, 14 and urges the ridges 46 apart. This causes the panels 12, 14 to pivot at the tabs 36, 38, 42 area and urges the lower end 24 of each panel apart. The tapered portion of the distal end 68 extends beyond the contact area of the ridge 46 and the ridge 46 contacts the parallel sides 67 second section 66 so that the lower ends 24 of the panels 12, 14 are maintained locked in the spaced apart position. The floor sign 10 can now be stable and free standing for use.

When the floor sign 10 is to be collapsed, the user inserts his/her fingers in the notch 26 and lifts upward on the distal end 68, which urges the locking bar 16 upward and distal end 68 withdraws from contacting the ridges 46. The panels 12, 14 can then pivot back to a generally parallel and closed position for transport and storage.

OTHER APPLICATIONS

While the embodiment described above relates preferably to a conventional "wet floor sign" the present invention can also be used or adapted for use as a "sawhorse", police barricade or other structure. The present invention also contemplates that the opening and closure mechanism can be used with structures other than angled floor signs, such as, but not limited to, clamps for removably securing items together or removably maintaining them in a spaced apart relationship (spreader clamp). The present invention can also be adapted for use as an opening and closure device for suitcases, briefcases and the like. Additionally, the present invention can be adapted to function as a set of tongs or grips to releasably grasp objects, such as logs or other object between two pincers which would replace the front and rear panels. Moreover, the present invention can be adapted to provide an opening and closing mechanism for a folding chair or table so that the legs are maintained locked in a fixed position, yet can be easily folded or collapsed for transportation or storage.

ADVANTAGES

An advantage of the present invention is that the floor sign 10 can be operated using one hand making it easier and quicker to deploy or collapse. When the user desires to collapse the unit, he/she need only lift the sign and the locking bar 16 will lift and enable the panels to pivot into the collapsed position.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

It should further be noted that any patents, applications and publications referred to herein are incorporated by reference in their entirety.

What is claimed is:

1. A floor sign, comprising:

a) a generally flat front panel comprising i) an inner face having a left side and a right side, ii) an outer face, iii) an upper end, iv) a lower end for resting on the ground or floor, v) a notch formed therein, vi) at least one first tab having an aperture formed therein extending from said upper end of said inner face, vii) a second tab having a boss extending from both faces thereof and extending from said upper end of said inner face, said boss being generally coaxial with said at least one first tab aperture, viii) a ridge extending from said left side of said inner face, and ix) a ridge extending from said right side of said inner face;

b) a generally flat rear panel comprising i) an inner face having a left side and a right side, ii) an outer face, iii) an upper end, iv) a lower end for resting on the ground or floor, v) a notch formed therein, vi) at least one first tab having an aperture formed therein extending from said upper end of said inner face, vii) a second tab having a boss extending from both faces thereof and extending from said upper end of said inner face, said boss being generally coaxial with said at least one first tab aperture, viii) a ridge extending from said left side of said inner face, and, ix) a ridge extending from said right side of said inner face; and, c) a locking bar pivotably coupling said front panel and said rear panel together for opening and closing movement relative to one another, said locking bar comprising, i) a generally flat horizontal top first section, and ii) a downwardly extending vertical second section having a proximal end associated with said first section and a distal end, said distal end being tapered, said locking bar being movable from an upper position to a lower position when coupling said front panel and said rear panel such that when said locking bar is in said upper position said front panel and said rear panel lower ends are in close proximity so as to be in a closed position and when said locking bar is in said lower position said locking bar tapered distal end engages said ridges and urges apart said lower ends of said front panel and said rear panel so as to be in an open position.

2. The floor sign of claim 1, wherein said locking bar is urged into said lower position by pushing said top first section downward toward said lower end and said locking bar is urged into said upper position by urging said distal end upward.

3. A device for maintaining a structure in an expanded or closed position, comprising:

a) a first panel comprising
- i) an inner face having a left side and a right side,
- ii) an outer face,
- iii) an upper end,
- iv) a lower end,
- v) a notch formed therein,
- vi) at least one first tab having an aperture formed therein extending from said upper end of said inner face,
- vii) a second tab having a boss extending from both faces thereof and extending from said upper end of said inner face, said boss being generally coaxial with said at least one first tab aperture,
- viii) a ridge extending from said left side of said inner face, and
- ix) a ridge extending from said right side of said inner face;

b) a second panel comprising
- i) an inner face having a left side and a right side,
- ii) an outer face,
- iii) an upper end,
- iv) a lower end,
- v) a notch formed therein,
- vi) at least one first tab having an aperture formed therein extending from said upper end of said inner face,
- vii) a second tab having a boss extending from both faces thereof and extending from said upper end of said inner face, said boss being generally coaxial with said at least one first tab aperture,
- viii) a ridge extending from said left side of said inner face, and
- ix) a ridge extending from said right side of inner face; and, c) a locking bar pivotably coupling said first panel and said second panel together for opening and closing movement relative to one another, said locking bar comprising,
- i) a generally flat horizontal top first section, and
- ii) a downwardly extending vertical second section having a proximal end associated with said first section and a distal end, said distal end being tapered, said locking bar being movable from an upper position to a lower position when coupling said first panel and said second panel such that when said locking bar is in said upper position said first panel and said second panel lower ends are in close proximity so as to be in a closed position and when said locking bar is in said lower position said locking bar tapered distal end engages said ridges and urges apart said lower ends of said first panel and said second panel so as to be in an open position.

4. A releasably lockable folding structure, comprising two panels pivotably coupled together and moveable relative to one another between a locked deployed position and an unlocked collapsed position and a locking bar for locking said structure in said locked deployed position, wherein said structure automatically locks in said locked deployed position upon movement of said structure from said unlocked collapsed position to said locked deployed position.

5. The releasably lockable folding structure of claim 4, wherein said structure moves between said locked deployed position to said unlocked collapsed position upon application of a force to said locking bar.

6. The releasably lockable folding structure of claim 4, wherein said force is upwardly directed.

7. The releasably lockable folding structure of claim 4, wherein each of said panels comprises at least one first tab having an aperture formed therein and a second tab having at least one boss, said boss being generally coaxial with said aperture of said first tab.

8. The releasably lockable folding structure of claim 7, wherein said boss is fitted into said aperture of said first tab to form a hinge coupling.

9. The releasably lockable folding structure of claim 4, wherein each of said panels comprises at least one ridge, each of said ridges interacting with said locking bar, such that when said locking bar is lowered and is pressing against said ridge, said panels are in said locked deployed position, and when said locking bar is raised away from said ridge, said panels are in said unlocked collapsed position.

10. The releasably lockable folding structure of claim 4, wherein each of said panels comprises a first ridge extending from the left side of each of said panels and a second ridge extending from the right side of each of said panels.

11. The releasably lockable folding structure of claim 4, wherein said locking bar comprises a top member and a vertically depending elongated member.

12. The releasably lockable folding structure of claim 4, wherein each panel comprises a notch, sized to receive a portion of said locking bar.

13. The releasably lockable folding structure of claim 4, wherein said structure comprises a folding floor sign.

14. A releasably lockable folding structure comprising:

(a) a plurality of panels, each panel having an outer side and an inner side, each inner side having at least one coupling mechanism, each of said panels being pivotably connected at its coupling mechanism to at least one other of said panels at the corresponding coupling mechanism to form a hinge, said panels configured such that said inner sides of said panels face one another to form an interior of said releasably lockable folding structure, and (b) one or more locking bars, each locking bar being positioned at said hinge such that said panels coupled together at said hinge are movable relative to one another between a locked deployed position and an unlocked collapsed position.

15. The releasably locking folding structure of claim 14, wherein said panels coupled together at said hinge move from said locked deployed position to said unlocked collapsed position upon application of a force to said locking bar.

16. The releasably lockable folding structure of claim 15, wherein said force is in a direction opposing said interior of said releasably lockable folding structure.

17. The releasably lockable folding structure of claim 14, wherein each of said coupling mechanisms comprise at least one first tab having an aperture formed therein and a second tab having at least one boss, said boss being generally coaxial with said aperture of said first tab.

18. The releasably lockable folding structure of claim 14, wherein each of said coupling mechanisms comprises at least one ridge, each of said ridges interacting with the corresponding locking bar, such that moving said locking bar toward said interior presses said locking bar against said ridge, thereby urging said panels coupled together at said hinge into said locked deployed position, and such that moving locking bar away from said ridge in a direction opposing said interior permits said panels coupled together at said hinge to be moved to said unlocked collapsed position.

19. The releasably lockable folding structure of claim 14, wherein each panel comprises a notch, sized to receive a portion of said locking bar.

20. The releasably lockable folding structure of claim 14, wherein said locking bar comprises a generally flat outer member and an elongated inner member, said elongated inner member having a proximal end associated with said outer member and a tapered distal end.

21. The releasably lockable folding structure of claim 14, wherein said elongated inner member comprises one or more beveled projection stops which prevent said locking bar from being removed from said releasably lockable folding structure.

22. A releasably lockable folding structure, comprising two panels pivotably coupled together and moveable relative to one another between a locked deployed position and an unlocked collapsed position and a locking bar for locking said structure in said locked deployed position, each of said panels comprising at least one first tab having an aperture formed therein and a second tab having at least one boss that is generally coaxial with said aperture of said first tab and that is fitted into said aperture of said first tab to form a hinge coupling, said locking bar located between said panels at said hinge coupling.

23. A releasably lockable folding structure, comprising two panels pivotably coupled together and moveable relative to one another between a locked deployed position and an unlocked collapsed position and a locking bar for locking said structure in said locked deployed position, wherein each of said panels comprises two first tabs, each of two first tabs having an aperture formed therein, and a second tab having a boss extending from both faces thereof, said boss being generally coaxial with said first tab apertures.

24. A releasably lockable folding structure, comprising two panels pivotably coupled together and moveable relative to one another between a locked deployed position and an unlocked collapsed position and a locking bar for locking said structure in said locked deployed position, wherein said locking bar comprises a generally flat and horizontal top member and a vertically depending elongated member having a proximal end associated with said top member and a distal end.

25. The releasably lockable folding structure of claim 24, wherein said distal end is tapered.

26. The releasably lockable folding structure of claim 24, wherein each of said panels comprises a cutout, enabling a user to apply a vertical force upon said distal end such that said panels are moved into said unlocked collapsed position.

27. A releasably lockable folding structure, comprising two panels pivotably coupled together and moveable relative to one another between a locked deployed position and an unlocked collapsed position and a locking bar for locking said structure in said locked deployed position, wherein said locking bar comprises a top member and a vertically depending elongated member comprising one or more beveled projection stops which prevent said locking bar from being removed from said releasably lockable folding structure.

28. A releasably lockable folding structure, comprising two panels pivotably coupled together and moveable relative to one another between a locked deployed position and an unlocked collapsed position and a vertically moveable locking bar for locking said structure in said locked deployed position, wherein said locking bar comprises a generally flat and horizontal top member and a vertically depending elongated member, said vertically depending elongated member having a proximal end associated with said top member and a distal end, each of said panels comprising at least one ridge, said ridge interacting with said distal edges of said locking bar, such that lowering said locking bar presses said distal edges against said ridge, urging said panels into said locked deployed position, and raising said locking bar permits movement of said panels to said unlocked collapsed position.

29. A releasable lockable folding structure, comprising two panels pivotably coupled together with a vertically moveable locking bar, each of said panels comprising at least one ridge, at least one first tab having an aperture formed therein, and a second tab having at least one boss, said boss being generally coaxial with said aperture of said first tab, and said ridges interacting with said locking bar, such that lowering said locking bar presses said locking bar against said ridges, thereby urging said panels into a locked deployed position, and such that raising said locking bar permits movement of said panels into an unlocked collapsed position.

30. A releasably lockable folding structure, comprising two panels pivotably coupled together with a vertically moveable locking bar, said locking bar comprising a generally flat and horizontal top member and a vertically depending elongated member, said vertically depending elongated member having a proximal end associated with said top member and a tapered distal end, each of said panels comprising at least one ridge, said ridges interacting with said locking bar, such that lowering said locking bar presses said locking bar against said ridges, thereby urging said panels into a locked deployed position, and such that raising said locking bar permits movement of said panels into an unlocked collapsed position.

31. The releasably lockable folding structure of claim 30, wherein each of said panels comprises a cutout, enabling a user to apply a vertical force upon said tapered distal end such that said panels are moved into said unlocked collapsed position.

32. The releasably lockable folding structure of claim 30, wherein said vertically depending elongated member comprises one or more beveled projection stops which prevent said locking bar from being removed from said releasably lockable folding structure.

* * * * *